US005415070A

United States Patent [19]

Kaman

[11] Patent Number: 5,415,070

[45] Date of Patent: May 16, 1995

[54] CHIN REST FOR A STRINGED INSTRUMENT

[76] Inventor: Peter J. Kaman, 1309 Dexter Ave. North, Apt. 305, Seattle, Wash. 98109

[21] Appl. No.: 193,486

[22] Filed: Feb. 8, 1994

Related U.S. Application Data

[63] Continuation-in-part of Ser. No. 110,560, Aug. 23, 1993, abandoned.

[51] Int. Cl.[6] ..... G10D 1/02

[52] U.S. Cl. ..... 84/279; 224/910

[58] Field of Search ..... 84/278, 279, 280; 224/910

[56] References Cited

U.S. PATENT DOCUMENTS 217,330 7/1879 Bull ..... 84/279

360,408 4/1887 Becker ..... 84/279

*Primary Examiner*—M. I. Gellner

*Assistant Examiner*—Cassandra C. Spyrou

[57] ABSTRACT

A chin rest assembly includes a mounting block assembly and a chin rest. The mounting block assembly is constructed to be mounted to the back end of a musical instrument and is constructed for releasably securing the chin rest to the musical instrument. The chin rest includes a mounting portion, a chin rest portion, and an extending portion, wherein the extending portion is positioned generally intermediate the mounting portion and the chin rest portion. When coupled to the musical instrument, the chin rest portion of the chin rest is positioned remote from the back end of the musical instrument so that the musical instrument is not positioned intermediate the chin and shoulder of the user.

2 Claims, 2 Drawing Sheets

CHIN REST FOR A STRINGED INSTRUMENT

Related Application

This application is a continuation-in-part of U.S. patent application Ser. No. 08/110,560 filed Aug. 23, 1993 for "CHIN REST FOR A VIOLIN OR THE LIKE," by Peter J. Kaman now abandon.

TECHNICAL FIELD

The present invention relates to a chin rest for a musical instrument and, more particularly, to a chin rest for a violin wherein the chin rest extends outward from the back end of the violin, thereby allowing the violin to be held farther away from the body of a user.

BACKGROUND OF THE INVENTION

Prior art chin rests for violins, violas, or the like, come in many different shapes and sizes. However, all prior art chin rests are constructed to provide uniform positioning of a user's chin in relation to the position of the musical instrument. In accordance with the prior art chin rests, a resting place is constructed to clamp directly over the instrument itself, thereby making the effective length of the instrument fixed. With the instrument length unchangeable, the performer is forced to make adjustments with his upper and lower arm, as well as wrist, in order to maintain a desired relationship to the instrument.

Invariably, for taller users, this adjustment includes a contraction in the arm, which contraction can cause difficulty in playing. Furthermore, the contraction can lead to injuries of the back, neck, and joints of the user. Commonly, tendonitis, muscle compression, and carpal tunnel syndrome result from extensive playing of the violin in the contracted position. As a result, users for whom the contracted position affects playing ability and/or leads to severe injury may be required to change instruments.

In addition to the foregoing, the inability of the prior art chin rest to adjust for variation in the arm length of users, thus requiring the above-noted contracted playing position, can lead to further complications. As an example, the user is typically forced to make compensation in the playing position of the right arm, which is usually used to hold the bow that strokes the violin strings, so that the orientation between the bow and the violin string can be in the accepted perpendicular relationship. The user can also be forced to make compensations in the positioning of the left hand, as a result of the contracted playing position, which compensations can lead to restriction of free movement, inability to play in tune, and inability to play with significant of bravado.

Still further, the conventional placement of the chin rest over the violin can be undesirable even for users having conventional arm sizes. Since the conventional chin rest relies upon the shoulder supporting the violin, a dampening contact is created that prevents free vibration and is undesired for a singing tone. Similar dampening can be caused by the jaw, in opposition to the shoulder.

Accordingly, it is desirable to construct a chin rest that is capable of being positioned at various locations with respect to the musical instrument.

SUMMARY OF THE INVENTION

In accordance with the present invention, a chin rest assembly is provided for coupling to a musical instrument. The musical instrument has a front end constructed to be gripped by a hand of a user and a back end constructed to be proximate a chin of the user. The back end defines a back surface intermediate first and second sides of the instrument. The chin rest assembly includes a chin rest having a coupling end, a chin rest end, and an extending portion intermediate the coupling end and the chin rest end. The chin rest end is constructed to engage the chin of the user when the musical instrument is in use. The extending portion is constructed of a length selected to extend the chin rest end outward from the back of the musical instrument in a direction generally defined as the direction from the front end of the musical instrument to the back end so that the musical instrument is extended away from the user when it is in use. The chin rest assembly further includes a coupling device for releasably coupling the chin rest to the back end of the musical instrument.

In an alternative embodiment of the invention, the chin rest assembly further includes a mounting block for mounting the chin rest to the back end of the musical instrument. The mounting block is constructed to be mounted to the musical instrument. The coupling end of the chin rest is provided with a device for releasably securing the chin rest to the mounting block.

DETAILED DESCRIPTION OF THE INVENTION

Figure 1:
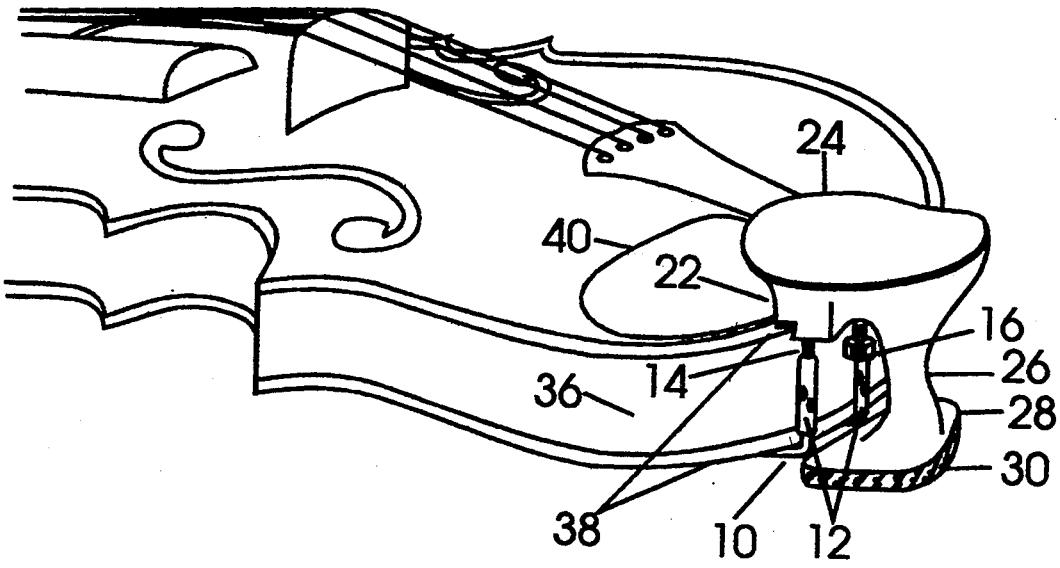
FIGS. 1 and 2 are side views of the chin rest of the subject invention coupled to a violin.
Figure 2:
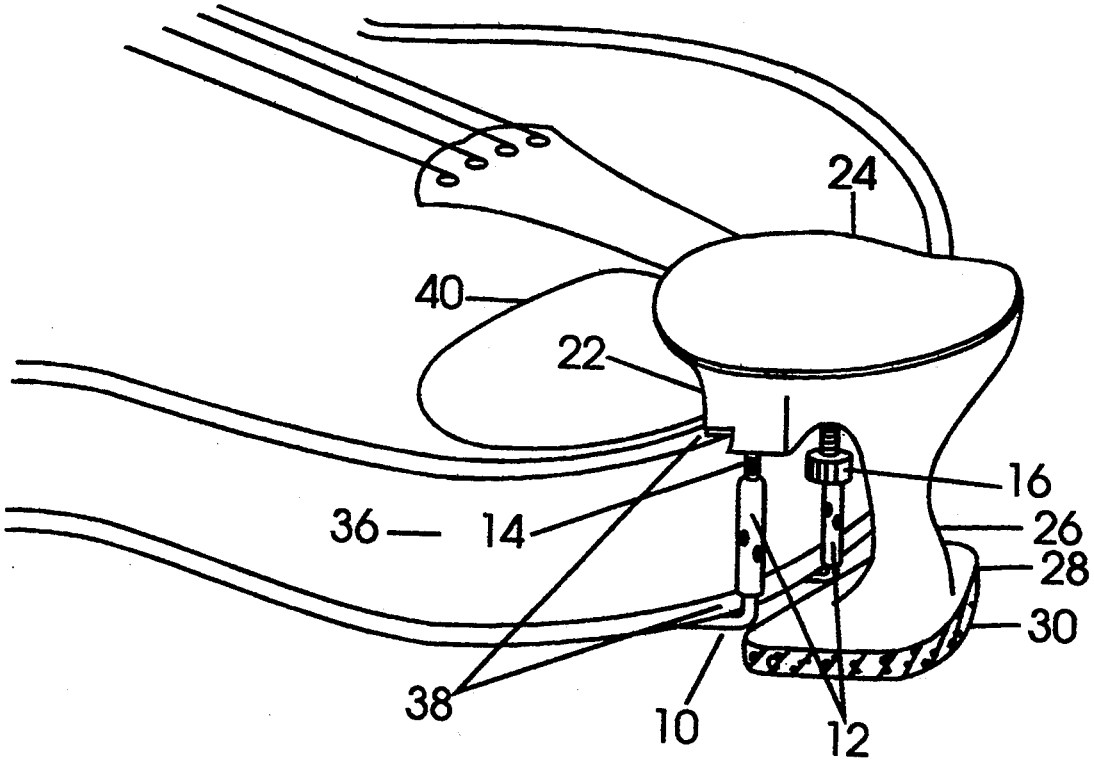

In accordance with the present invention, a chin rest assembly 100 is provided and constructed to be coupled to a musical instrument. The chin rest of the present invention is specifically constructed for use with violins, violas, or other similar instruments. A typical violin 102 for use with the chin rest assembly of the present invention is illustrated in FIGS. 1 and 2. Those skilled in the art will appreciate, however, that the present invention can be used with any musical instrument wherein it is desired to support the musical instrument at one end between the chin and shoulder of a user.

The violin 102 has a front end 104 that is constructed to be gripped by a hand of the user, typically the left hand. The violin 102 also has a back end 106. The back end 106 includes first and second sides 108 and 110. The chin rest assembly 100 includes a mounting block assembly 112 (best illustrated in FIG. 3) that is constructed to be mounted to the back end of the musical instrument.

The mounting block assembly 112 includes a bracket 300 having a mounting portion 302 that is covered with a first layer cushioning material 304. The first layer of cushioning material 304 is glued to the mounting portion 302 in a position designed to be intermediate the mounting portion 302 and the second side 110 when the mounting block assembly is coupled to the violin 102.

The bracket 300 also includes first and second threaded connector pins 306 and 308 extending outward from the bracket 300 so that when the mounting portion 302 is engaged with the second side 110, the first and second threaded connector pins 306 and 308 extend in a direction from the second side 110 to the first side 108 of the violin 102.

The mounting block assembly 112 further includes a mounting block 310 that is constructed to be coupled to the bracket 300. The mounting block includes top and bottom sides 312 and 314 and forward and backward ends 316 and 318, respectively. A second layer of cushioning material 320 is fixed to the bottom side 314. As illustrated in FIGS. and 2, the bottom side is constructed to engage the first side of the violin 102 when the mounting block assembly 112 is coupled thereto. The second layer of cushioning material 320 is positioned to be intermediate the bottom side 314 and the first side 108 of the violin 102.

The mounting block 310 also includes third and fourth threaded connector pins 322 and 324 that extend outward from the bottom side 314. The third and fourth threaded connector pins 322 and 324 are positioned intermediate the forward and backward ends 316 and 318 so that when the mounting block 310 is engaged with the first side 108 of the violin 102, the third and fourth threaded connector pins 322 and 324 extend in a direction from the first side 108 to the second side 110 and the forward end 316 is intermediate the front end 104 and the back end 106 of the violin 102. In this position, the backward end 318 extends outward from the back end 106 of the violin 102. As will be discussed in more detail below, the extension of the backward end 318 from the violin 102 enables one of the unique features of the present invention.

Figure 3:
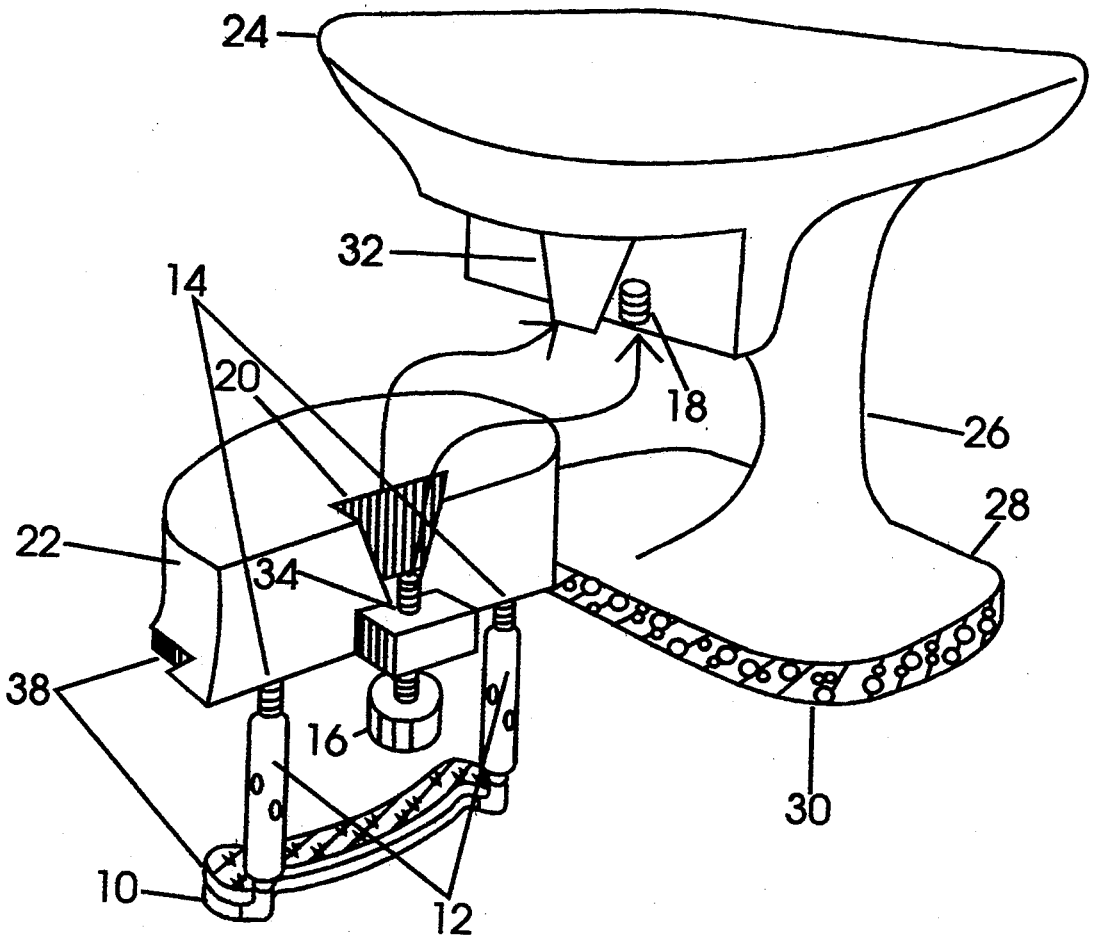
FIG. 3 is a view of the chin rest of the subject invention.

The mounting block 310 further includes a coupling assembly 326 for releasably coupling the mounting block assembly 112 to a chin rest 328. As illustrated in FIG. 3, the coupling assembly 326 is a female dovetail joint 330 constructed in the backward end 318 and extending from the top side 312 to the bottom side 314. An abutting protrusion 332 is positioned intermediate the female dovetail joint 330 and the bottom side 314. The abutting protrusion 332 extends outward from the backward end 318 and includes a threaded throughole 334 with a securing screw 336 threadably mated to the threaded throughole 334. Although the coupling device 326 has been described in part by reference to a dovetail joint 330 herein, those skilled in the art will appreciate that other mechanisms for releasably coupling the chin rest 328 to the mounting block assembly 112 may be readily provided without departing from the present invention.

The mounting block assembly 112 further includes first and second turnbuckle connectors 336 and 338 each including first and second threaded througholes (not shown). The first and second threaded throughole of the first turnbuckle connector 336 are constructed to mate with the first and third threaded connector pins 306 and 322 of the bracket 300 and mounting block 310, respectively. Similarly, the first and second threaded throughole of the second turnbuckle connector 338 are constructed to mate with the second and fourth threaded connector pins 308 and 324 of the bracket 300 and mounting block 310, respectively. In this manner, the first and second turnbuckle connectors 336 and 338 can be used as is known in the art to couple the bracket 300 to the mounting block 310 and thereby to mount the mounting block assembly 112 to the back end 106 of the violin 102. Importantly, the mounting block assembly 112 is releasably couplable to the violin 102. Those skilled in the art will appreciate that other constructions for releasably coupling the mounting block assembly 112 to the violin 102 may be provided without departing from the subject invention.

The chin rest assembly 100 further includes a chin rest 328 having a chin rest plate 340. The chin rest plate 340 includes upper and lower sides 342 and 344. The chin rest plate has a coupling end 346, a chin rest end 348, and an extending portion 350, wherein the extending portion is positioned generally intermediate the coupling end and the chin rest end. The chin rest end 348 has an elongated mounting extension 352 that extends outward from the lower side 344 and terminates in an abutting end 354. The elongated mounting extension 352 has a male dovetail connector 356 constructed to mate with the female dovetail connector 330 of the mounting block 310 so that the elongated mounting extension 352 abuts the backward end 318 of the mounting block 310. The abutting end 354 of the elongated mounting extension 352 has a threaded retainer 358 constructed to receive the securing screw 336 of the mounting block 310 thereby to releasably mount the chin rest 328 to the mounting block 310 with the coupling end proximate the back end 106 of the violin 102.

The extending portion 350 is constructed of a length selected to extend the chin rest away from the back end of the violin 102 so that the violin is extended away from the user when it is in use. As a result of this mounting structure, the extending portion 350 intermediate the chin rest end 348 and the coupling end 346, the chin rest end 348 extends outward from the violin 102 (best illustrated in FIGS. 1 and 2) in a direction generally defined from the front end 104 to the back end 106 of the violin 102. The coupling assembly 326 is positioned generally intermediate the violin 102 and the chin rest portion 348.

Accordingly, in operation, the chin of the user is positioned backward of the violin 102. This backward positioning provides an essential elongation of the violin thereby permitting more comfort to users having varying arm lengths. Furthermore, since the chin is not positioned proximate the first side 108 of the violin 102, in the prior art position, the chin does not provide the normal dampening to the violin thereby enhancing the overall tone provided to a user.

The chin rest 328 further includes a throat 362 that is fixed to the lower side 344 of the chin rest end 348 and extends outward from the chin rest end 348 in a direction generally defined from the first side 108 to the second side 110 of the violin 102. A collar bone support 360 is fixed to the throat 362 opposite the chin rest end 348. The collar bone support 360 has a third layer of cushioning material 364 fixed thereto.

Those skilled in the art will readily appreciate that by varying the construction of the extending portion 350, the chin rest can be positioned at various lengths behind the back end 106 of the violin 102, thereby to accommodate users having varying arm sizes. Furthermore, those skilled in the art will appreciate that the extending portion 350 could be constructed in a manner to permit a user to vary its length, thereby providing a somewhat universal chin rest to accommodate users having varying arm lengths.

While the present invention has been described with reference to a preferred embodiment thereof, those skilled in the art will appreciate that various changes in form and detail may be made without departing from the present invention as defined in the appended claims.

I claim:

1. A chin rest assembly for coupling to a musical instrument, wherein the musical instrument has a front end constructed to be gripped by a hand of a user and a back end, the back end having first and second sides, said assembly comprising:

a bracket constructed to be mounted to the back end of the musical instrument, said bracket having a mounting portion covered with a first layer of cushioning material wherein said mounting portion is constructed to engage the second side of the back end with said first layer of cushioning material intermediate said mounting portion and said second side, said bracket also including first and second threaded connector pins extending outward from said bracket so that when said mounting portion is engaged with said second side, said first and second threaded connector pins extend in a direction from the second side to the first side of the back end;

a mounting block constructed to be coupled to said bracket, said mounting block having top and bottom sides and forward and backward ends with a second layer of cushioning material fixed to said bottom side wherein said bottom side is constructed to engage the first side of the back end with said second layer of cushioning material intermediate said bottom side and the first side of the back end, said mounting block also including third and fourth threaded connector pins extending outward from said bottom side, intermediate said forward and backward ends so that when said mounting block is engaged with the first side of the back end, said third and fourth threaded connector pins extend in a direction from the first side of the back end to the second side of the back end and said forward end is intermediate the front end and the back end of the musical instrument and said backward end extends outward from the back end of the musical instrument, said mounting block further including a female dovetail joint constructed in said backward end extending from said top side to said bottom side and an abutting protrusion positioned intermediate said female dovetail joint and said bottom side, said abutting protrusion extending outward from said backward end and including a threaded throughole with a securing screw threadably mated to said threaded throughole;

first and second turnbuckle connectors each including first and second threaded througholes, said first and second threaded throughole of said first turnbuckle connector being constructed to mate with said first and third threaded connector pins of said bracket and said mounting block, respectively, and said first and second threaded throughole of said second turnbuckle connector being constructed to mate with said second and fourth threaded connector pins of said bracket and said mounting block, respectively, to couple said bracket to said mounting block and thereby mount said bracket and said mounting block to the back end of the musical instrument; and a chin rest including a chin rest plate having upper and lower sides and including a coupling end, a chin rest end and an extending portion intermediate said coupling end and said chin rest end, said chin rest end having an elongated mounting extension extending outward from said lower side and ending in an abutting end, said elongated mounting extension having a male dovetail connector constructed to mate with said female dovetail connector of said mounting block so that said elongated mounting extension abuts said backward end of said mounting block, said abutting end of said elongated mounting extension having a threaded retainer constructed to receive said securing screw of said mounting block thereby to mount said chin rest to said mounting block with said coupling end proximate the back end of the musical instrument and said chin rest end extending outward from the musical instrument in a direction generally defined from the front end to the back end of the musical instrument, said chin rest also including a throat fixed to said lower side of said chin rest end and extending outward from said chin rest end in a direction generally defined from the first side to the second side of the back end, a collar bone support being fixed to said throat, opposite said chin rest end and having a third layer of cushioning material mounted thereto, said extending portion being constructed of a length selected to extend said chin rest end away from the back end of the musical instrument so that the musical instrument is extended away from the user when it is in use.

2. A chin rest assembly for coupling to a musical instrument, wherein the musical instrument has a front end constructed to be gripped by a hand of a user and a back end, the back end having first and second sides, said assembly comprising:

a chin rest including a chin rest plate having upper and lower sides and having a coupling end, a chin rest end and an extending portion intermediate said coupling end and said chin rest end, said chin rest end extending outward from the musical instrument is a direction generally defined from the front end to the back end of the musical instrument, said chin rest including a throat fixed to said lower side of said chin rest end and extending outward from said chin rest end in a direction generally defined from the first side to the second side of the back end, a collar bone support being fixed to said throat, opposite said chin rest end and having a third layer of cushioning material mounted thereto, said extending portion being constructed of a length selected to extend said chin rest end away from the back end of the musical instrument so that the musical instrument is extended away from the user when it is in use; and mounting means for mounting said chin rest to the back end of the musical instrument, said mounting means being constructed to be mounted to the back end of the musical instrument, said chin rest end of said chin rest including means for releasably mounting said chin rest to said mounting means; and, a bracket constructed to be mounted to the back end of the musical instrument, said bracket having a mounting portion covered with a first layer of cushioning material wherein said mounting portion is constructed to engage the second side of the back end with said first layer of cushioning material intermediate said mounting portion and said second side, said bracket also including first and second threaded connector pins extending outward from said bracket so that when said mounting portion is engaged with said second side, said first and second threaded connector pins extend in a direction from the second side to the first side of the back end;

a mounting block constructed to be coupled to said bracket, said mounting block having top and bottom sides and forward and backward ends with a second layer of cushioning material fixed to said bottom side wherein said bottom side is constructed to engage the first side of the back end with said second layer of cushioning material intermediate said bottom side and the first side of the back end, said mounting block also including third and fourth threaded connector pins extending outward from said bottom side, intermediate said forward and backward ends so that when said mounting block is engaged with the first side of the back end, said third and fourth threaded connector pins extend in a direction from the first side of the back end to the second side of the back end and said forward end is intermediate the front end and the back end of the musical instrument and said backward end extends outward from the back end of the musical instrument: and first and second turnbuckle connectors each including first and second threaded throughholes, said first and second threaded throughholes of said first turnbuckle connector being constructed to mate with said first and third threaded connector pins of said bracket and said mounting block, respectively, and said first and second threaded throughholes of said second turnbuckle connector being constructed to mate with said second and fourth threaded connector pins of said bracket and said mounting block, respectively, to couple said bracket to said mounting block and thereby mount said bracket and said mounting block to the back end of the musical instrument.

* * * * *